US010211516B2

(12) United States Patent
Soh et al.

(10) Patent No.: US 10,211,516 B2
(45) Date of Patent: Feb. 19, 2019

(54) ELECTRONIC DEVICE INCLUDING ANTENNA

(71) Applicant: Samsung Electronics Co., Ltd., Suwon-si, Gyeonggi-do (KR)

(72) Inventors: Minho Soh, Suwon-si (KR); Sangmin Jung, Anyang-si (KR); Gwangun Oh, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 67 days.

(21) Appl. No.: 15/427,429

(22) Filed: Feb. 8, 2017

(65) Prior Publication Data

US 2017/0237150 A1 Aug. 17, 2017

(30) Foreign Application Priority Data

Feb. 17, 2016 (KR) ..... 10-2016-0018443

(51) Int. Cl.

| | |
|---|---|
| ***H01Q 1/24*** | (2006.01) |
| ***H01Q 9/42*** | (2006.01) |
| ***H01Q 21/28*** | (2006.01) |
| ***H01Q 5/35*** | (2015.01) |
| ***H01Q 5/371*** | (2015.01) |
| ***H01Q 5/385*** | (2015.01) |

(52) U.S. Cl.

CPC ..... *H01Q 1/243* (2013.01); *H01Q 5/35* (2015.01); *H01Q 5/371* (2015.01); *H01Q 5/385* (2015.01); *H01Q 9/42* (2013.01); *H01Q 21/28* (2013.01)

(58) Field of Classification Search

CPC ..... H01Q 1/243; H01Q 9/42; H01Q 21/28; H01Q 5/35

See application file for complete search history.

(56) References Cited

U.S. PATENT DOCUMENTS

| | | | | |
|---|---|---|---|---|
| 2012/0162025 | A1* | 6/2012 | Ohno | H01Q 1/243 343/702 |
| 2012/0262345 | A1* | 10/2012 | Kim | H01Q 1/243 343/702 |
| 2017/0062930 | A1* | 3/2017 | Chen | H01Q 1/243 |
| 2017/0104261 | A1* | 4/2017 | Wong | H01Q 1/243 |

FOREIGN PATENT DOCUMENTS

KR 1580546 B1 12/2015

* cited by examiner

*Primary Examiner* — Dieu Hien T Duong
(74) *Attorney, Agent, or Firm* — Jefferson IP Law, LLP

(57) ABSTRACT

An electronic device including an antenna is provided. The electronic device includes a housing, a radio frequency (RF) circuit located within the housing and configured to output a first RF signal and a second RF signal, at least one processor located within the housing and configured to electrically connect to the RF circuit, a first radiating body electrically connected to the RF circuit, a second radiating body electrically connected to the first radiating body, and an RF switch located within the housing and electrically connected to the processor and the second radiating body, wherein the at least one processor is further configured to control the RF switch to emit at least one of the first RF signal and the second RF signal output from the RF circuit to at least one of the first radiating body and the second radiating body.

16 Claims, 15 Drawing Sheets

ELECTRONIC DEVICE INCLUDING ANTENNA

CROSS-REFERENCE TO RELATED APPLICATION(S)

This application claims the benefit under 35 U.S.C. § 119(a) of Korean patent application filed on Feb. 17, 2016 in the Korean Intellectual Property Office and assigned Serial number 10-2016-0018443, the entire disclosure of which is hereby incorporated by reference.

TECHNICAL FIELD

The present disclosure relates to an electronic device including a metal housing using as an antenna.

BACKGROUND

In general, an electronic device (e.g., a smart phone) may have an antenna for wireless communication. At least a portion of a housing of the electronic device may be made of a metal, and a portion or the entire of the metal housing may be used as an antenna of the electronic device.

An electronic device of the related art includes an antenna and a power supply unit that applies a radio frequency (RF) signal to the antenna. It is difficult to form resonance of a low frequency band to a high frequency band, i.e., a broadband with an antenna and a power supply unit.

Further, in the electronic device of the related art, even if a desired frequency of resonance occurs, there is a problem that a performance of additional other necessary frequencies is deteriorated.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an electronic device including a plurality of power supply units that apply a radio frequency (RF) signal, an antenna that receives an RF signal from the power supply unit, and another antenna connected to the antenna by coupling.

Another aspect of the present disclosure is to provide an electronic device that performs wireless communication in a broadband using a plurality of power supply units.

In accordance with an aspect of the present disclosure, an electronic device is provided. The electronic device includes a housing, a radio frequency (RF) circuit located within the housing and configured to output a first RF signal and a second RF signal, at least one processor located within the housing and configured to electrically connect to the RF circuit, a first radiating body electrically connected to the RF circuit, a second radiating body electrically connected to the first radiating body, and an RF switch located within the housing and electrically connected to the processor and the second radiating body, wherein the at least one processor is further configured to control the RF switch to emit at least one of the first RF signal and the second RF signal output from the RF circuit to at least one of the first radiating body and the second radiating body.

In accordance with another aspect of the present invention disclosure, an electronic device is provided. The electronic device includes a housing, a RF circuit located within the housing and that outputs configured to output a first RF signal and a second RF signal, a at least one processor located within the housing and electrically connected to the RF circuit, a first radiating body electrically connected to the RF circuit, a second radiating body electrically connected to the first radiating body, and an RF switch located within the housing and electrically connected to the processor and the second radiating body, wherein the RF switch is connected to at least a portion of the second radiating body adjacent to the first radiating body.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description in conjunction with the accompanying drawings, in which.

Throughout the drawings, like reference numerals will be understood to refer to like parts, components, and structures.

DETAILED DESCRIPTION

Figure 1:
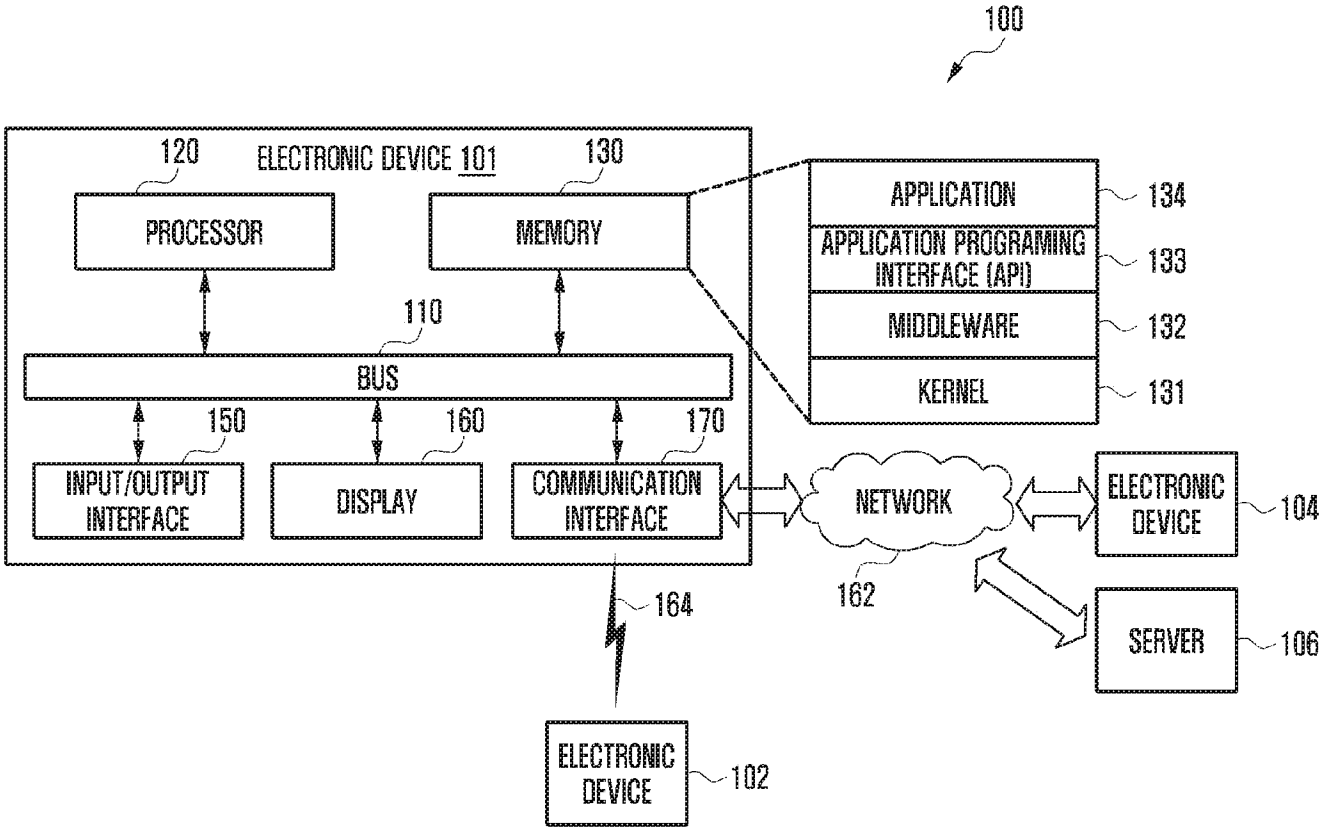
FIG. 1 is a block diagram illustrating a network environment according to various embodiments of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a", "an", and "the", include plural referents unless the context clearly dictates otherwise. Thus, for example, reference to "a component surface" includes reference to one or more of such surfaces.

The expressions such as "include" and "may include" which may be used in the present disclosure denote the presence of the disclosed functions, operations, and constituent elements, and do not limit one or more additional functions, operations, and constituent elements. In the present disclosure, the terms such as "include" and/or "have", may be construed to denote a certain characteristic, number, operation, constituent element, component or a combination thereof, but should not be construed to exclude the existence of or a possibility of the addition of one or more other characteristics, numbers, operations, constituent elements, components or combinations thereof.

In the present disclosure, the expression "and/or" includes any and all combinations of the associated listed words. For example, the expression "A and/or B" may include A, may include B, or may include both A and B.

In the present disclosure, expressions including ordinal numbers, such as "first", "second", and/or the like, may modify various elements. However, such elements are not limited by the above expressions. For example, the above expressions do not limit the sequence and/or importance of the elements. The above expressions are used merely for the purpose of distinguishing an element from the other elements. For example, a first user device and a second user device indicate different user devices, although both are user devices. For further example, a first element could be termed a second element, and similarly, a second element could also be termed a first element without departing from the scope of the present disclosure.

In the case where a component is referred to as being "connected" or "accessed" to another component, it should be understood that not only is the component connected or accessed to the other component, but also another component may exist between the component and the other component. In the case where a component is referred to as being "directly connected" or "directly accessed" to another component, it should be understood that there is no component therebetween.

Unless otherwise defined, all terms including technical and/or scientific terms used herein have the same meaning as commonly understood by one of ordinary skill in the art to which the present disclosure pertains. In addition, unless otherwise defined, all terms defined in generally used dictionaries may not be overly interpreted.

The electronic device corresponds to at least one of a smartphone, a tablet personal computer (PC), a mobile phone, a video phone, an e-book reader, a desktop PC, a laptop PC, a netbook computer, a personal digital assistant (PDA), a portable multimedia player (PMP), a digital audio player (e.g., Moving Picture Experts Group phase 1 or phase 2 (MPEG-1 or MPEG-2) audio layer 3 (MP3) player), a mobile medical device, a camera, or a wearable device. Examples of the wearable device include a head-mounted-device (HMD) (e.g., electronic eyeglasses), electronic clothing, an electronic bracelet, an electronic necklace, an appcessory, an electronic tattoo, a smart watch, and the like.

The electronic device according to various embodiments of the present disclosure may also include various smart home appliances. Examples of such smart home appliances may include a television (TV), a digital versatile disc (DVD) player, an audio system, a refrigerator, an air-conditioner, a cleaning device, an oven, a microwave oven, a washing machine, an air cleaner, a set-top box, a TV box (e.g., Samsung HomeSync™, Apple TV™, or Google TV™), a game console, an electronic dictionary, an electronic key, a camcorder, an electronic album, or the like.

The electronic device according to various embodiments of the present disclosure may also include medical devices (e.g., magnetic resonance angiography (MRA), magnetic resonance imaging (MRI), computed tomography (CT), a scanning machine, an ultrasonic scanning device, and the like), a navigation device, a global positioning system (GPS) receiver, an event data recorder (EDR), a flight data recorder (FDR), a vehicle infotainment device, an electronic equipment for ships (e.g., navigation equipment, gyrocompass, and the like), avionics, a security device, a head unit for vehicles, an industrial or home robot, an automatic teller's machine (ATM), a point of sales (POS) system, and the like.

The electronic device according to various embodiments of the present disclosure may also include furniture or a portion of a building/structure, an electronic board, an electronic signature receiving device, a projector, various measuring instruments (e.g., a water meter, an electric meter, a gas meter and a wave meter) and the like. The electronic device according to various embodiments of the present disclosure may also include a combination of the devices listed above. In addition, the electronic device according to various embodiments of the present disclosure may be a flexible and/or contoured device. It should be obvious to those skilled in the art that the electronic device according to various embodiments of the present disclosure is not limited to the aforementioned devices.

Hereinafter, electronic devices according to various embodiments of the present disclosure will be described in detail with reference to the accompanying drawings. In the description, the term a 'user' may refer to a person or a device that uses or otherwise controls the electronic device, e.g., an artificial intelligent electronic device.

FIG. 1 illustrates a network environment including an electronic device according to various embodiments of the present disclosure.

Referring to FIG. 1, an electronic device 101 of a network environment 100 may include a bus 110, a processor 120 (i.e., at least one processor), a memory 130, an input/output (I/O) interface 150, a display 160 and a communication interface 170.

The bus 110 may be a communication circuit that connects the components to each other and transfers data (e.g., control messages) between the components.

The processor 120 may receive instructions from the components (e.g., the memory 130, I/O interface 150, display 160 and communication interface 170) via the bus 110, decode the instructions and perform corresponding operations or data processing according to the decoded instructions.

The memory 130 may store instructions or data transferred from/created in the processor 120 or the other components (e.g., I/O interface 150, display 160 and communication interface 170). The memory 130 may include programming modules, e.g., a kernel 131, a middleware 132, an application programming interface (API) 133, and an application module 134. Each of the programming modules may be software, firmware, hardware or a combination thereof.

The kernel 131 may control or manage system resources (e.g., the bus 110, processor 120, and memory 130) used to execute operations or functions of the programming modules, e.g., the middleware 132, API 133, and application module 134. The kernel 131 may also provide an interface that can access and control/manage the components of the electronic device 101 via the middleware 132, API 133, and application module 134.

The middleware 132 may make it possible for the API 133 or application module 134 to perform data communication with the kernel 131. The middleware 132 may also perform control operations (e.g., scheduling and load balancing) for task requests transmitted from the application module 134 using, for example, a method for assigning the order of priority to use the system resources (e.g., the bus 110, processor 120, and memory 130) of the electronic device 101 to at least one of the applications of the application module 134.

The API 133 is an interface that allows the application module 134 to control functions of the kernel 131 or middleware 132. For example, the API 133 may include at least one interface or function (e.g., instruction) for file control, window control, character control, video process, and the like.

In various embodiments of the present disclosure, with reference to FIG. 1, the application module 134 may include applications that are related to short message service (SMS)/multimedia messaging service (MMS), email, calendar, alarm, health care (e.g., an application for measuring blood sugar level, a workout application, and the like), and environment information (e.g., atmospheric pressure, humidity, temperature, and the like). The application module 134 may be an application related to exchanging information between the electronic device 101 and the external electronic devices (e.g., an electronic device 104). The information exchange-related application may include a notification relay application for transmitting specific information to an external electronic device or a device management application for managing external electronic devices.

For example, the notification relay application may include a function for transmitting notification information, created by the other applications of the electronic device 101 (e.g., SMS/MMS application, email application, health care application, environment information application, and the like), to an external electronic device (e.g., electronic device 104). In addition, the notification relay application may receive notification information from an external electronic device (e.g., electronic device 104) and provide it to the user. The device management application can manage (e.g., install, delete, or update) part of the functions of an external electronic device (e.g., electronic device 104) communicating with the electronic device 101, e.g., turning on/off the external electronic device, turning on/off part of the components of the external electronic device, adjusting the brightness or the display resolution of the display of the external electronic device, and the like, applications operated in the external electronic device, or services from the external electronic device, e.g., call service or messaging service, and the like.

In various embodiments of the present disclosure, the application module 134 may also include applications designated according to attributes (e.g., type of electronic device) of the external electronic device (e.g., electronic device 104). For example, if the external electronic device is an MP3 player, the application module 134 may include an application related to music playback. If the external electronic device is a mobile medical device, the application module 134 may include an application related to health care. In an embodiment of the present disclosure, the application module 134 may include an application designated in the electronic device 101 and applications transmitted from external electronic devices (e.g., server 106, electronic device 104, and the like).

The I/O interface 150 may receive instructions or data from the user via an I/O system (e.g., a sensor, keyboard or touch screen) and transfers them to the processor 120, memory 130 or communication interface 170 through the bus 110. For example, the I/O interface 150 may provide data corresponding to a user's touch input to a touch screen to the processor 120. The I/O interface 150 may receive instructions or data from the processor 120, memory 130 or communication interface 170 through the bus 110, and output them to an I/O system (e.g., a speaker or a display). For example, the I/O interface 150 may output voice data processed by the processor 120 to a speaker.

The display 160 may display information (e.g., multimedia data, text data, and the like) on a screen so that the user can view it.

The communication interface 170 may communicate between the electronic device 101 and an external system (e.g., an electronic device 104 or server 106). For example, the communication interface 170 may connect to a network 162 in a wireless or wired mode, and communicate with the external system. Wireless communication may include Wi-Fi, Bluetooth (BT), near field communication (NFC), GPS or cellular communication (e.g., long term evolution (LTE), LTE-advanced (LTE-A), code division multiple access (CDMA), wideband CDMA (WCDMA), universal mobile telecommunications system (UMTS), wireless broadband (Wi-Bro), global system for mobile communications (GSM), and the like). In addition, the wireless communication may include, for example, short range communication 164. Wired communication may include universal serial bus (USB), high definition multimedia interface (HDMI), recommended standard 232 (RS-232), plain old telephone service (POTS), and the like.

In an embodiment of the present disclosure, the network 162 may be a telecommunication network. The telecommunication network may include a computer network, Internet, Internet of things (IoT), telephone network, and the like. The protocol for communication between the electronic device 101 and the external system, e.g., transport layer protocol, data link layer protocol, or physical layer protocol, may be supported by at least one of the application module 134, API 133, middleware 132, kernel 131 and communication interface 170.

Figure 2:
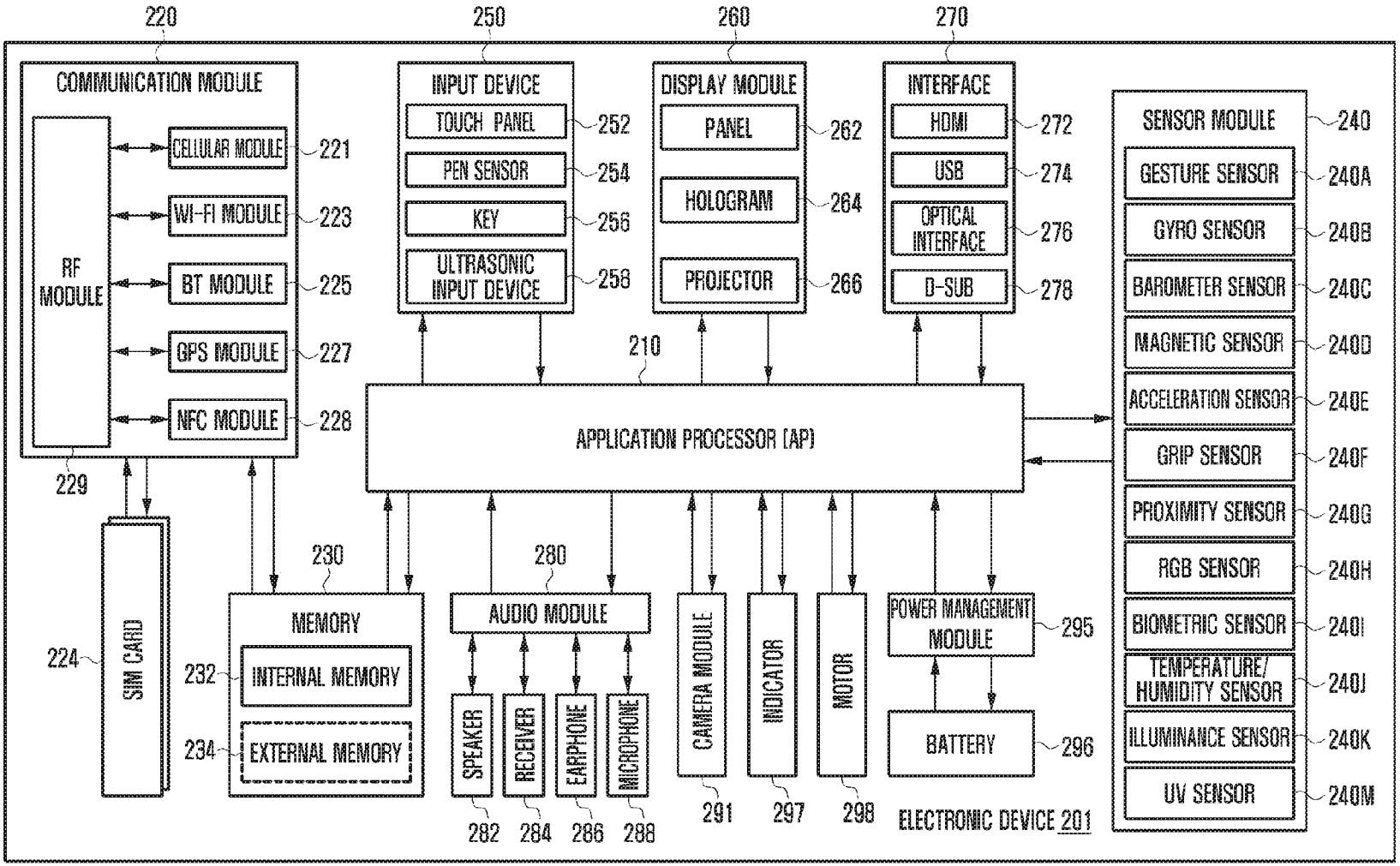
FIG. 2 is a block diagram illustrating a configuration of an electronic device according to various embodiments of the present disclosure.

FIG. 2 illustrates a block diagram of an electronic device according to various embodiments of the present disclosure.

Referring to FIG. 2, an electronic device 201 may be all or part of the electronic device 101 as shown in FIG. 1, and may include one or more processors of an application processor (AP) 210, a communication module 220, a subscriber identification module (SIM) card 224, a memory 230, a sensor module 240, an input device 250, a display module 260, an interface 270, an audio module 280, a camera module 291, a power management module 295, a battery 296, an indicator 297, and a motor 298.

The AP 210 may control a number of hardware or software components connected thereto by executing the operation system or applications, process data including multimedia data, and perform corresponding operations. The AP 210 may be implemented with a system on chip (SoC). In an embodiment of the present disclosure, the AP 210 may further include a graphics processing unit (GPU).

The communication module 220 (e.g., communication interface 170) performs communication for data transmission/reception between the other electronic devices (e.g., an electronic device 102 or 104, and server 106) that are connected to the electronic device (e.g., electronic device 101) via the network. In an embodiment of the present disclosure, the communication module 220 may include a cellular module 221, a Wi-Fi module 223, a BT module 225, a GPS module 227, an NFC module 228 and a radio frequency (RF) module 229.

The cellular module 221 may provide voice call, video call, SMS or Internet service, and the like, via a communication network (e.g., LTE, LTE-A, CDMA, WCDMA, UMTS, Wi-Bro, GSM, and the like). The cellular module 221 may also perform identification or authentication for electronic devices in a communication network by using their SIM (e.g., SIM card 224). In an embodiment of the present disclosure, the cellular module 221 may perform part of the functions of the AP 210. For example, the cellular module 221 may perform part of the functions for controlling multimedia.

In an embodiment of the present disclosure, the cellular module 221 may include a communication processor (CP). The cellular module 221 may be implemented with, for example, a SoC. Although the embodiment of the present disclosure shown in FIG. 2 is implemented in such a way that the cellular module 221 (e.g., CP), the power management module 295, the memory 230, and the like, are separated from the AP 210, an embodiment can be modified in such a way that the AP 210 includes at least part of the listed elements or other elements of the device 201 (e.g., cellular module 221).

In an embodiment of the present disclosure, the AP 210 or the cellular module 221 (e.g., CP) may load instructions or data transmitted to and from at least one of a non-volatile memory or other components, on a volatile memory and then process them. The AP 210 or the cellular module 221 may also store data which is transmitted from/created in at least one of the components, in a non-volatile memory.

The Wi-Fi module 223, the BT module 225, the GPS module 227 and the NFC module 228 may include processors for processing transmission/reception of data, respectively. Although the embodiment of the present disclosure shown in FIG. 2 is implemented in such a way that the cellular module 221, Wi-Fi module 223, BT module 225, GPS module 227, and NFC module 228 are separated from each other, an embodiment can be modified in such a way that parts of the elements (e.g., two or more) are included in an integrated chip (IC) or an IC package. For example, part of the processors corresponding to the cellular module 221, Wi-Fi module 223, BT module 225, GPS module 227, and NFC module 228, e.g., a CP corresponding to the cellular module 221 and a Wi-Fi processor corresponding to the Wi-Fi 223, may be implemented with a SoC.

The RF module 229 may transmit or receive data, e.g., RF signals. The RF module 229 may include a transceiver, a power amplifier module (PAM), a frequency filter, a low noise amplifier (LNA), and the like. The RF module 229 may also include parts for transmitting/receiving electromagnetic waves, e.g., conductors, wires, and the like, via free space during wireless communication. Although the embodiment of the present disclosure shown in FIG. 2 is implemented in such a way that the cellular module 221, Wi-Fi module 223, BT module 225, GPS module 227, and NFC module 228 share the RF module 229, an embodiment can be modified in such a way that at least one of the elements transmit or receive RF signals via a separate RF module.

The SIM card 224 may be a card with a SIM. The SIM card 224 may be fitted into a slot of the electronic device. The SIM card 224 may include unique identification information, e.g., integrated circuit card identifier (ICCID), or subscriber information, e.g., international mobile subscriber identity (IMSI).

The memory 230 (e.g., memory 130) may include built-in or internal memory 232 and/or external memory 234. The internal memory 232 may include at least one of a volatile memory, e.g., dynamic random access memory (DRAM), static RAM (SRAM), synchronous dynamic RAM (SDRAM), and the like, non-volatile memory, e.g., one time programmable read only memory (OTPROM), programmable ROM (PROM), erasable and programmable ROM (EPROM), electrically erasable and programmable ROM (EEPROM), mask ROM, flash ROM, NAND flash memory, NOR flash memory, and the like.

In an embodiment of the present disclosure, the internal memory 232 may be a solid state drive (SSD). The external memory 234 may further include a flash drive, e.g., compact flash (CF), secure digital (SD), micro-SD, mini-SD, extreme digital (XD), a memory stick, and the like. The external memory 234 may be functionally connected to the electronic device via various types of interfaces. In an embodiment of the present disclosure, the electronic device 101 may further include storage devices or storage media such as hard drives.

The sensor module 240 may measure a physical quantity or sense operation states of the electronic device 201 and convert the measured or sensed data into electrical signals. The sensor module 240 may include at least one of a gesture sensor 240A, a gyro sensor 240B, an atmospheric pressure (barometer) sensor 240C, a magnetic sensor 240D, an acceleration sensor 240E, a grip sensor 240F, a proximity sensor 240G, a color sensor 240H (e.g., a red-green-blue (RGB) sensor), a biosensor (biometric sensor) 240I, a temperature/humidity sensor 240J, an illuminance sensor 240K, and an ultra-violet (UV) sensor 240M.

The sensor module 240 may also include an electronic nose (e-nose) sensor, electromyography (EMG) sensor, an electroencephalogram (EEG) sensor, an electrocardiogram (ECG) sensor, an infrared (IR) sensor, a fingerprint sensor, an iris sensor, and the like. The sensor module 240 may further include a control circuit for controlling the one or more sensors.

The input device 250 may include a touch panel 252, a pen sensor 254 (i.e., a digital pen sensor or digital stylus), a key 256 and an ultrasonic input device 258. The touch panel 252 may sense touches using a capacitive sensing mode, a pressure sensing mode, an infrared sensing mode, and an ultrasonic sensing mode. The touch panel 252 may further include a control circuit. When the touch panel 252 is designed to operate in a capacitive sensing mode, the panel can also sense mechanical/physical touches or proximity of an object. The touch panel 252 may further include a tactile layer. In that case, the touch panel 252 can also provide tactile feedback to the user.

The pen sensor 254 (i.e., digital pen sensor) may be detected in a same or similar way as receiving a user's touch input or by using a separate recognition sheet. The key 256 may include mechanical buttons, optical keys or a key pad. The ultrasonic input device 258 is a device that can sense sounds via a microphone 288 of the electronic device 201 by using an input tool for generating ultrasonic signals, and then receiving and checking data associated with the signals. The ultrasonic input device 258 can sense signals in a wireless mode. In an embodiment of the present disclosure, the electronic device 201 may also receive a user's inputs from an external system (e.g., a computer or server) via the communication module 220.

The display module 260 (e.g., display 160 shown in FIG. 1) may include a panel 262, a hologram unit 264, or a projector 266. The panel 262 may be implemented with a liquid crystal display (LCD), active matrix organic light emitting diodes (AMOLEDs), or the like. The panel 262 may be implemented in a flexible, transparent, impact-resistant, and/or wearable form. The panel 262 may form a single module with the touch panel 252. The hologram unit 264 shows a three-dimensional image in the air using interference of light. The projector 266 may display images by projecting light on a screen. The screen may be placed, for example, inside or outside of the electronic device 201. In an embodiment of the present disclosure, the display module 260 may further include a control circuit for controlling the panel 262, the hologram unit 264, or the projector 266.

The interface 270 may include a HDMI 272, a USB 274, an optical interface 276, a D-subminiature (D-sub) 278, and the like. The interface 270 may also be included in the communication interface 170 shown in FIG. 1. The interface 270 may also include a mobile high-definition link (MHL) interface, an SD card, a multi-media card (MMC) interface, an infrared data association (IrDA) standard interface, or the like.

The audio module 280 may provide conversions between audio and electrical signals. At least part of the components in the audio module 280 may be included in the I/O interface 150 shown in FIG. 1. The audio module 280 may process audio output from/input to, for example, a speaker 282, a receiver 284, earphones 286, the microphone 288, and the like.

The camera module 291 may take still images or moving images. In an embodiment of the present disclosure, the camera module 291 may include one or more image sensors (e.g., on the front side and/or the back side), a lens, an image signal processor (ISP), a flash (e.g., an LED or a xenon lamp), or the like.

The power management module 295 may manage electric power supplied to the electronic device 201. The power management module 295 may include a power management integrated circuit (PMIC), a charger IC, a battery or fuel gauge, and the like.

The PMIC may be implemented in the form of an IC chip or SoC. Charging electric power may be performed in wired and/or wireless modes. The charger IC may charge a battery, and prevent input over-voltage or input over-current to the battery from a charger. In an embodiment of the present disclosure, the charger IC may be implemented with a wired charging type and/or a wireless charging type. Examples of the wireless charging type of the charger IC are a magnetic resonance type, a magnetic induction type, an electromagnetic type, an acoustic type, and the like. If the charger IC is implemented with a wireless charging type, it may also include an additional circuit for wireless charging, e.g., a coil loop, a resonance circuit, a rectifier, and the like.

The battery gauge may measure a residual amount of the battery 296, a level of voltage, a level of current, a temperature during the charge, and the like. The battery 296 stores electric power and supplies it to the electronic device 201. The battery 296 may include a rechargeable battery or a solar battery.

The indicator 297 shows states of the electronic device 201 or of the parts thereof (e.g., the AP 210), e.g., a booting state, a message state, a recharging state, and the like. The motor 298 converts an electrical signal into a mechanical vibration. Although not shown, the electronic device 201 may include a processor for supporting a mobile TV, e.g., a GPU. The mobile TV supporting processor may process media data that complies with standards of digital multimedia broadcasting (DMB), digital video broadcasting (DVB), media flow, and the like.

Each of the elements/units of the electronic device according to the present disclosure may be implemented with one or more components, and may be called different names according to types of electronic devices. The electronic device according to the present disclosure may include at least one element described above. The electronic device may also be modified in such a way as to remove part of the elements or include new elements. In addition, the electronic device according to the present disclosure may also be modified in such a way that parts of the elements are integrated into one entity that performs their original functions.

In the present disclosure, the terminology 'module' refers to a 'unit' including hardware, software, firmware or a combination thereof. For example, the terminology 'module' is interchangeable with 'unit,' 'logic,' 'logical block,' 'component,' 'circuit,' and the like. A 'module' may be the least identifiable unit or part of an integrated component. A 'module' may also be the least unit or part thereof that can perform one or more functions of the module. A 'module' may be implemented through mechanical or electronic modes. For example, 'modules' according to various embodiments of the present disclosure may be implemented with at least one of an application specific integrated circuit (ASIC) chip, a field-programmable gate array (FPGAs) and a programmable-logic device that can perform functions that are known or will be developed.

Figure 3:
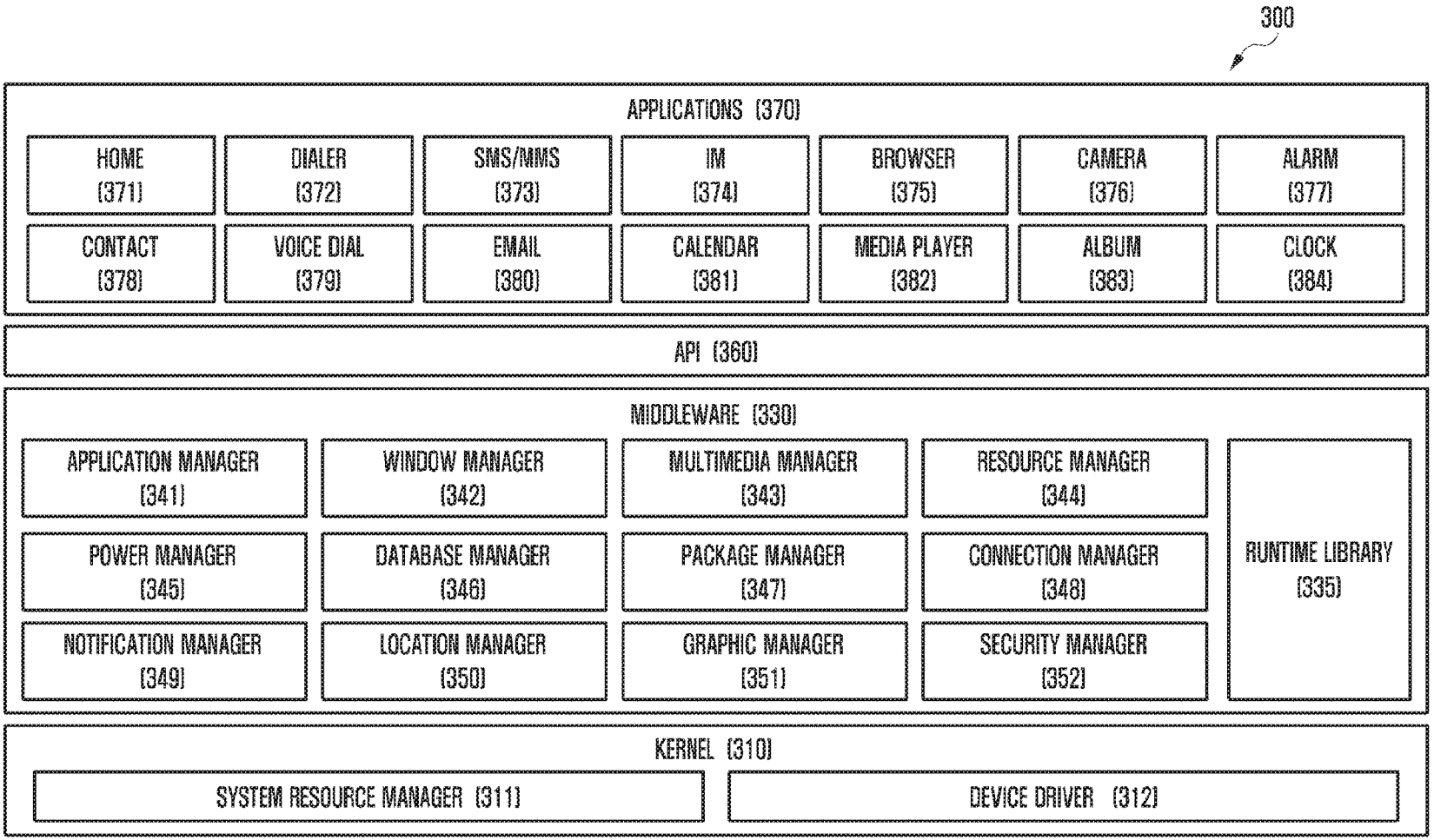
FIG. 3 is a block diagram illustrating a configuration of a program module according to various embodiments of the present disclosure.

FIG. 3 is a block diagram of a program module according to various embodiments of the present disclosure.

Referring to FIG. 3, a program module 300 may include an operating system (OS) for controlling resources related to the electronic device and/or various applications executed in the operating system. The OS may be, for example, Android™, iOS™, Windows™, Symbian®, Tizen®, Bada®, or the like.

The program module 300 includes a kernel 310, middleware 330, an API 360, and/or applications 370. At least some of the program module 300 may be preloaded on an electronic device, or may be downloaded from an external electronic device (e.g., the electronic device 102 or 104, or the server 106).

The kernel 310 may include, for example, a system resource manager 311 and/or a device driver 312. The system resource manager 311 may perform control, allocation, retrieval, or the like, of system resources. According to an embodiment, the system resource manager 311 may include a process manager, memory manager, file system manager, or the like. The device driver 312 may include, for example, a display driver, camera driver, BT driver, shared memory driver, USB driver, keypad driver, Wi-Fi driver, audio driver, or inter-process communication (IPC) driver.

The middleware 330 may provide a function required by the applications 370 in common, or provide various functions to the applications 370 through the API 360 so that the applications 370 can efficiently use limited system resources within the electronic device. According to an embodiment of the present disclosure, the middleware 330 may include, for example, at least one of a runtime library 335, an application manager 341, a window manager 342, a multimedia manager 343, a resource manager 344, a power manager 345, a database manager 346, a package manager 347, a connectivity (connection) manager 348, a notification manager 349, a location manager 350, a graphic manager 351, and a security manager 352.

The runtime library 335 may include a library module which a compiler uses in order to add a new function through a programming language while the applications 370 are being executed. The runtime library 335 may perform I/O management, memory management, functionality for an arithmetic function, or the like.

The application manager 341 may manage, for example, a life cycle of at least one of the applications 370. The window manager 342 may manage graphical user interface (GUI) resources used for the screen. The multimedia manager 343 may determine a format required to reproduce various media files, and may encode or decode a media file by using a coder/decoder (codec) appropriate for the corresponding format. The resource manager 344 may manage resources such as a source code, memory, and storage space of at least one of the applications 370.

The power manager 345 may operate together with a basic input/output system (BIOS) to manage a battery or other power, and may provide power information required for the operation of the electronic device. The database manager 346 may generate, search for, and/or change a database to be used by at least one of the applications 370. The package manager 347 may manage the installation or update of an application distributed in the form of a package file.

The connectivity manager 348 may manage a wireless connection such as, for example, Wi-Fi or BT. The notification manager 349 may display or notify of an event, such as an arrival message, appointment, proximity notification, and the like, in such a manner as not to disturb the user. The location manager 350 may manage location information of the electronic device. The graphic manager 351 may manage a graphic effect, which is to be provided to the user, or a user interface related to the graphic effect. The security manager 352 may provide various security functions required for system security, user authentication, and the like. According to an embodiment of the present disclosure, when the electronic device has a telephone call function, the middleware 330 may further include a telephony manager for managing a voice call function or a video call function of the electronic device.

The middleware 330 may include a middleware module that forms a combination of various functions of the above-described elements. The middleware 330 may provide a module specialized for each type of OS in order to provide a differentiated function. Also, the middleware 330 may dynamically delete some of the existing elements, or may add new elements as required.

The API 360 is, for example, a set of API programming functions, and may be provided with a different configuration according to an OS. For example, in the case of Android or iOS, one API set may be provided for each platform. In the case of Tizen, two or more API sets may be provided for each platform.

The applications 370 may include, for example, one or more applications which can provide functions such as home 371, dialer 372, SMS/MMS 373, instant message (IM) 374, browser 375, camera 376, alarm 377, contacts 378, voice dialer 379, email 380, calendar 381, media player 382, album 383, clock 384, health care (e.g., measure exercise quantity or blood sugar), or environment information (e.g., atmospheric pressure, humidity, or temperature information).

According to an embodiment of the present disclosure, the applications 370 may include an application (hereinafter, referred to as an "information exchange application" for convenience of the description) supporting information exchange between the electronic device and an external electronic device (e.g., the electronic device 102 or 104). The information exchange application may include, for example, a notification relay application for transferring specific information to an external electronic device or a device management application for managing an external electronic device.

For example, the notification relay application may include a function of transferring, to the external electronic device (e.g., the electronic device 102 or 104 shown in FIG. 1), notification information generated from other applications of the electronic device 101 (e.g., an SMS/MMS application, e-mail application, health management application, or environmental information application). Further, the notification relay application may receive notification information from, for example, an external electronic device and provide the received notification information to a user.

The device management application may manage (e.g., install, delete, or update), for example, at least one function of an external electronic device (e.g., the electronic device 102 or 104 shown in FIG. 1) communicating with the electronic device (e.g., a function of turning on/off the external electronic device or some components thereof, or a function of adjusting luminance or a resolution of the display), applications operating in the external electronic device, or services provided by the external electronic device (e.g., a call service and a message service).

According to an embodiment of the present disclosure, the applications 370 may include an application (e.g., a health care application of a mobile medical device or the like) designated according to an attribute of the external electronic device (e.g., the electronic device 102 or 104). According to an embodiment, the applications 370 may include an application received from the external electronic device (e.g., the server 106, or the electronic device 102 or 104). According to an embodiment of the present disclosure, the applications 370 may include a preloaded application or a third-party application which can be downloaded from the server. Names of the elements of the program module 300, according to the above-described embodiments of the present disclosure, may change depending on the type of OS.

Figure 4A:
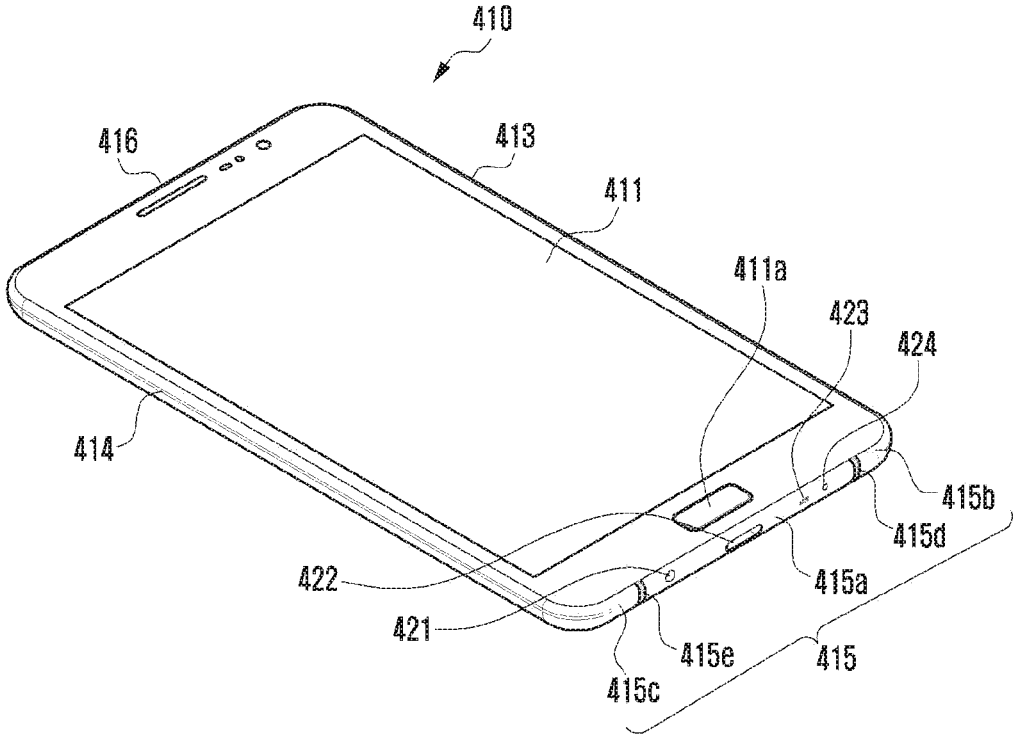
FIG. 4A is a perspective view illustrating a front surface and a low surface of an electronic device according to various embodiments of the present disclosure.
Figure 4B:
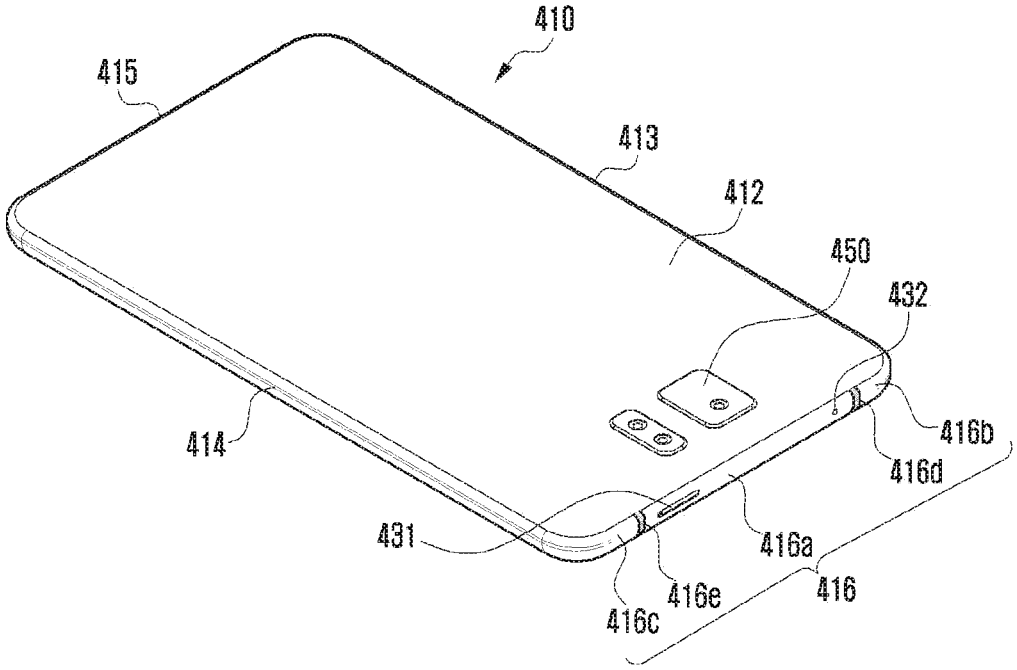
FIG. 4B is a perspective view illustrating a rear surface and an upper surface of an electronic device according to various embodiments of the present disclosure.

FIG. 4A is a perspective view illustrating a front surface and a low surface of an electronic device according to various embodiments of the present disclosure, and FIG. 4B is a perspective view illustrating a rear surface and an upper surface of an electronic device according to various embodiments of the present disclosure.

Referring to FIGS. 4A and 4B, an electronic device (e.g., the electronic device 101) may include various electronic components and a housing 410 for protecting the electronic components. The housing 410 may include a first plate 411 of a first direction, a second plate 412 of a second direction substantially opposite to the first direction, and a side surface member that encloses at least a portion of space between the first plate 411 and the second plate 412. For example, the first plate 411 may be a cover constituting a front surface of the electronic device, and a display may be exposed through a portion thereof. For example, the second plate 412 may be a cover constituting a rear surface of the electronic device. For example, a side surface member may include a right surface cover 413 constituting a right surface of the electronic device, a left surface cover 414 constituting a left surface of the electronic device, a low surface cover 415 constituting a low surface of the electronic device, and an upper surface cover 416 constituting an upper surface of the electronic device. The housing 410 may include a button 411*a* (e.g., a push-button or touch-button) as illustrated in FIG. 4A, and a camera 450, as illustrated in FIG. 4B.

Referring to FIG. 4A, at least a portion of the low surface cover 415 is made of a metal to be used as a radiating body for emitting an RF signal. For example, the low surface cover 415 may include a first metal portion 415*a*, second metal portion 415*b*, third metal portion 415*c*, first nonmetallic portion 415*d*, and second nonmetallic portion 415*e*. At the first metal portion 415*a*, an earphone hole 421, a hole 422 for wire connection to an external device, a speaker hole 423, and a microphone hole 424 may be punched. In another example, the second metal portion 415*b* and the third metal portion 415*c* may be located at both sides, respectively, of the first metal portion 415*a*. In another example, the first metal portion 415*a* may be separated from the second metal portion 415*b* by the first nonmetallic portion 415*d* and may be separated from the third metal portion 415*c* by the second nonmetallic portion 415*e*.

Referring to FIG. 4B, at least a portion of the upper surface cover 416 is made of a metal to be used as a radiating body. For example, the upper surface cover 416 may include a first metal portion 416*a*, second metal portion 416*b*, third metal portion 416*c*, first nonmetallic portion 416*d*, and second nonmetallic portion 416*e*. For example, at the first metal portion 416*a*, a hole 431 for inserting a subscriber identification module (SIM) card and a microphone hole 432 may be punched. According to an embodiment of the present disclosure, the second metal portion 416*b* may be formed in one metal with the second metal portion 415*b* of the low surface cover 415 and the right surface cover 413. The third metal portion 416*c* may be formed in one metal with the third metal portion 415*c* of the low surface cover 415 and the left surface cover 414. According to another embodiment, the second metal portion 416*b* may be separated from the right surface cover 413, and the third metal portion 416*c* may be separated from the left surface cover 414.

Figure 5A:
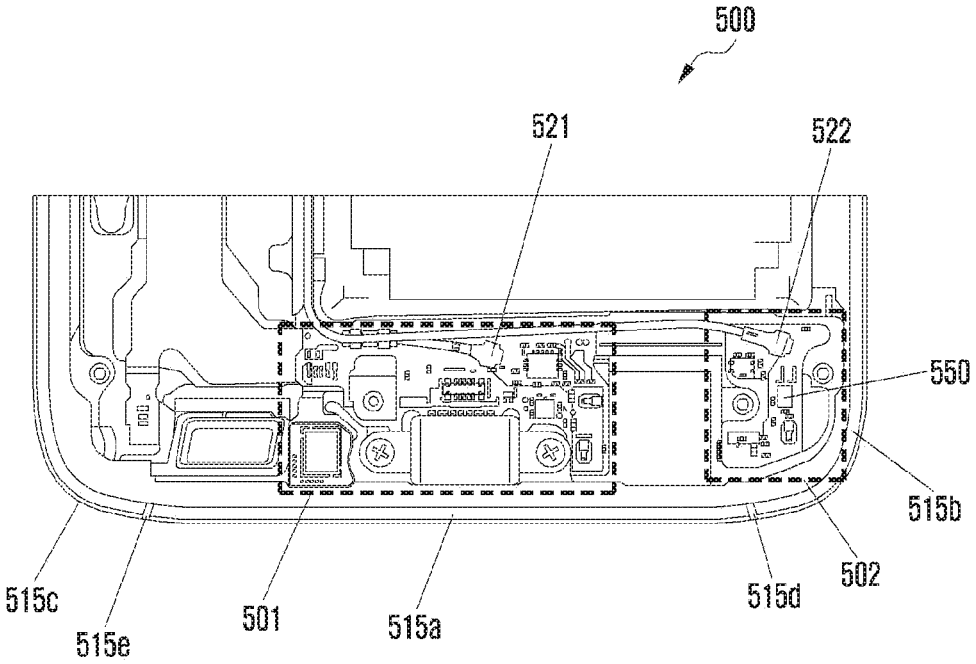
FIGS. 5A and 5B are diagrams illustrating a structure of an antenna device according to various embodiments of the present disclosure.
Figure 5B:
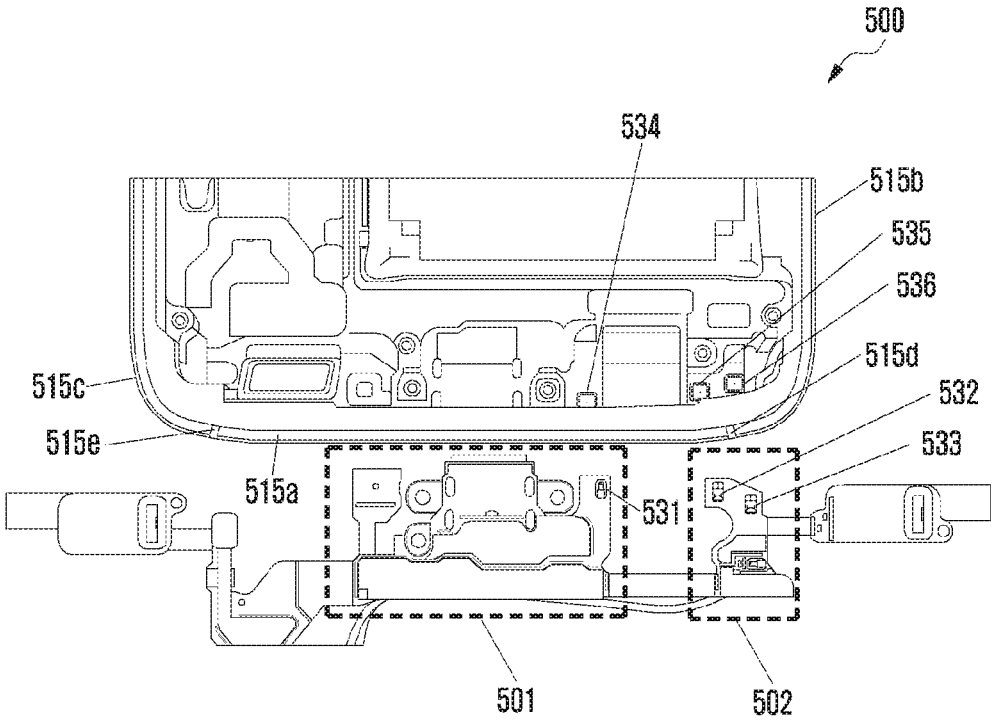

FIGS. 5A and 5B are diagrams illustrating a structure of an antenna device 500 according to various embodiments of the present disclosure.

Referring to FIGS. 5A and 5B, the antenna device 500 may be an element of an electronic device (e.g., the electronic device 101 shown in FIG. 1) and may include a first radiating body 515*a*, second radiating body 515*b*, third radiating body 515*c*, first separation portion 515*d*, and second separation portion 515*e*.

The first radiating body 515*a*, second radiating body 515*b* and/or third radiating body 515*c* according to various embodiments of the present disclosure may be elements of the first metal portion 415*a* or 416*a*, the second metal portion 415*b* or 416*b*, and the third metal portion 415*c* or 416*c*, respectively. For example, the first separation portion 515*d* may be an element of the first nonmetallic portion 415*d* or 416*d*. For example, the second separation portion 515*e* may be an element of the second nonmetallic portion 415*e* or 416*e*.

An electronic device according to various embodiments of the present disclosure may include a substrate for providing an electric signal to the radiating bodies 515*a*, 515*b* and/or 515*c*. The substrate may be formed with a first substrate 501 and a second substrate 502, and the first substrate 501 and the second substrate 502 may be electrically or physically connected. The first substrate 501 and/or the second substrate 502 may be formed in at least one of a printed circuit board (PCB) and a flexible circuit board (FPCB).

In the substrates 501 and 502 according to various embodiments of the present disclosure, a connection portion for feeding a current to the radiating bodies 515*a*, 515*b* and/or 515*c* may be mounted. In another example, the substrates 501 and 502 may operate as a ground plate that may ground the radiating bodies 515*a*, 515*b* and 515*c*, and a connection portion for operating the substrates 501 and 502 as a ground plate may be mounted in the substrates 501 and 502. For example, the connection portion may include at least one of a contact terminal (e.g., a pin (e.g., C-clip) having an elastic force), a solder pad, and a conductive wire.

In the first substrate 501, a first connection portion 521 and a second connection portion 522 for feeding a current to the first radiating body 515*a* may be mounted.

In the second substrate 502 according to various embodiments of the present disclosure, an RF switch 550 for adjusting a resonant frequency band and a third connection portion (not shown) electrically connected to the RF switch 550 may be mounted.

Referring to FIG. 5B, the first substrate 501 and the second substrate 502 of FIG. 5B may be a surface opposite to the first substrate 501 and the second substrate 502 of FIG. 5A.

In the first substrate 501, a first connection portion 531 (521 of FIG. 5A) for feeding a current to the first radiating body 515*a* may be mounted. When the first connection portion 531 contacts a fourth connection portion 534 electrically connected to the first radiating body 515*a*, the first substrate 501 and the first radiating body 515*a* may be electrically connected.

In the second substrate 502, a second connection portion 532 (522 of FIG. 5A) for feeding a current to the first radiating body 515*a* may be mounted. When the second connection portion 532 contacts a fifth connection portion 535 electrically connected to the first radiating body 515*a*, the second substrate 502 and the first radiating body 515*a* may be electrically connected.

In the second substrate 502, a third connection portion 533 electrically connected to the RF switch (550 of FIG. 5A) may be mounted. When the third connection portion 533 contacts a sixth connection portion 536 electrically connected to the second radiating body 515*b*, the RF switch (550 of FIG. 5A) and the second radiating body 515*b* may be electrically connected.

The first substrate 501 and the second substrate 502 according to various embodiments of the present disclosure may be formed in one device and may be formed in at least one of a printed circuit board (PCB) or a flexible circuit board (FPCB). Further, the first substrate 501 and the second substrate 502 may be formed in a plurality of forms. For example, the substrate may be formed in a PCB, and a partial area thereof may be formed in an FPCB.

According to various embodiments of the present disclosure, the fifth connection portion 535 and the sixth connection portion 536 may be represented with coupling capacitance.

Figure 6:
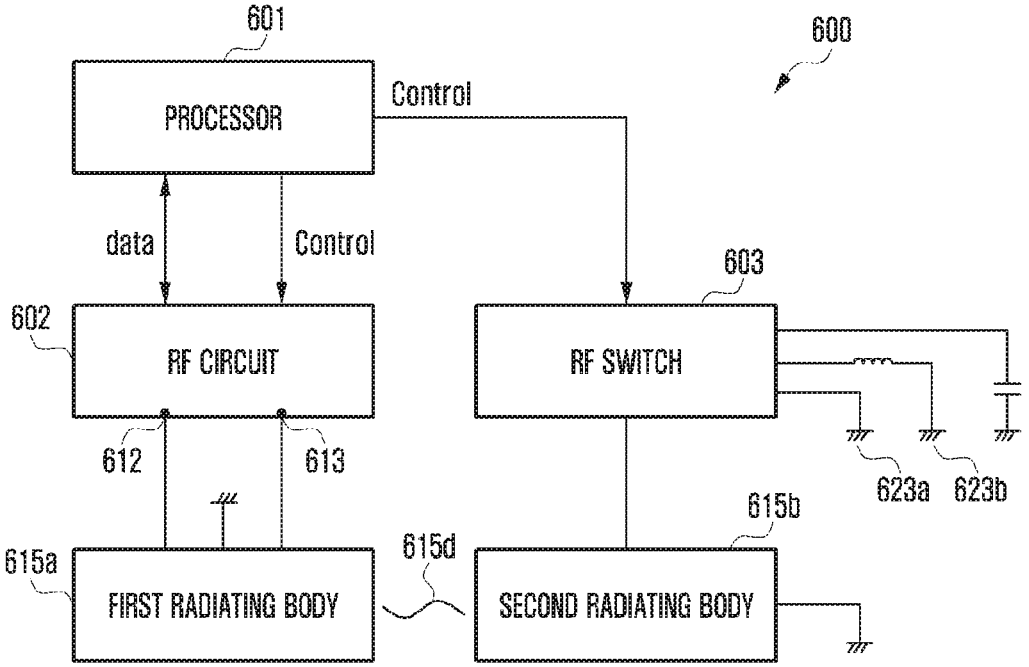
FIG. 6 is a block diagram illustrating an electric configuration of an electronic device according to various embodiments of the present disclosure.

FIG. 6 is a block diagram illustrating an electric configuration of an electronic device according to various embodiments of the present disclosure.

Referring to FIG. 6, an electronic device 600 may be an element of, for example the electronic device 101 and may include a first radiating body 615*a*, second radiating body 615*b*, RF circuit 602, RF switch 603 and/or processor 601. In the foregoing description, when describing the electronic device 500, the third radiating body 515*c* was described, but for easy description, only a first radiating body and a second radiating body will be described. The radiating body is not limited thereto and the third radiating body may be also an element of the electronic device 600.

The first radiating body 615*a* and the second radiating body 615*b* according to various embodiments of the present disclosure may be an element of the first radiating body 515*a* and the second radiating body 515*b*, respectively. For example, the first radiating body 615*a* and the second radiating body 615*b* may be spatially separated. For example, a separation portion 615*d* may be formed between the first radiating body 615*a* and the second radiating body 615*b*. The separation portion 615*d* may be made of a dielectric material. For example, the separation portion 615*d* may be formed with the first nonmetallic portion 415*d* or 416*d*.

The RF circuit 602 according to various embodiments of the present disclosure may convert data received from the processor 601 to an RF signal and may have a plurality of connection portions (a first connection portion 612, a second connection portion 613). For example, the RF circuit 602 may be formed with the RF module 227 and may output a first RF signal of a first frequency band (e.g., 600 Mhz-1 GHz; low band frequency) to the first connection portion 612. The RF circuit 602 may output a second RF signal of a second frequency band (e.g., 1.5 GHz-2.2 GHz, 2.5 GHz-2.7 GHz; mid and high band frequencies) to the first radiating body 615*a* through the second connection portion 613. The plurality of connection portions 612 and 613 may have a form of a contact terminal.

The processor 601 controls communication and power supply of the RF circuit 602, controls the RF switch 603, and may be formed with, for example a cellular module 221 or the processor 210.

The processor 601 according to various embodiments of the present disclosure controls a signal applied to the RF switch 603 to change a circuit configuration of the second radiating body 615*b*. When an RF signal applied to the first connection portion 612 or the second connection portion 613 is transferred to a second radiating body 615*b* through a resonant path (e.g., the separation portion 615*d*) to be emitted to the outside, emission efficiency can be enhanced.

According to various embodiments of the present disclosure, the processor 601 controls a signal applied to the RF switch 603 to connect the RF switch 603 to a ground 623*a*, thereby forming a resonant path of a high band frequency of mid and high band frequencies, which are a second frequency band and enhancing emission efficiency.

According to various embodiments of the present disclosure, the processor 601 controls a signal applied to the RF switch 603 to connect the RF switch 603 to an optimized passive element 623*b* (e.g., an inductor L having a value of 5.1 nH), thereby forming a resonant path of a mid-band frequency among mid and high band frequencies, which are a second frequency band and enhancing emission efficiency.

Figure 7A:
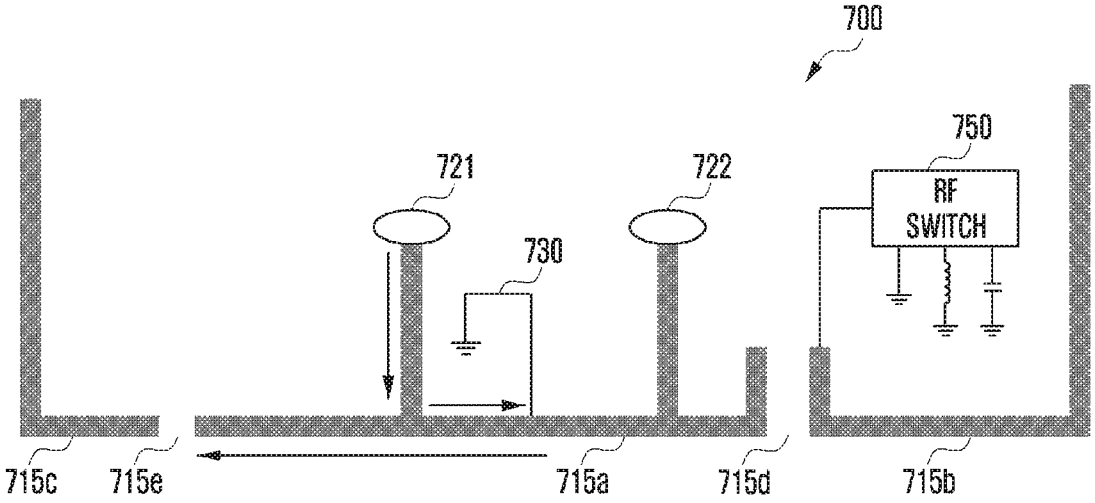
FIG. 7A is a block diagram illustrating a path of an electric signal of an electronic device according to various embodiments of the present disclosure.
Figure 7B:
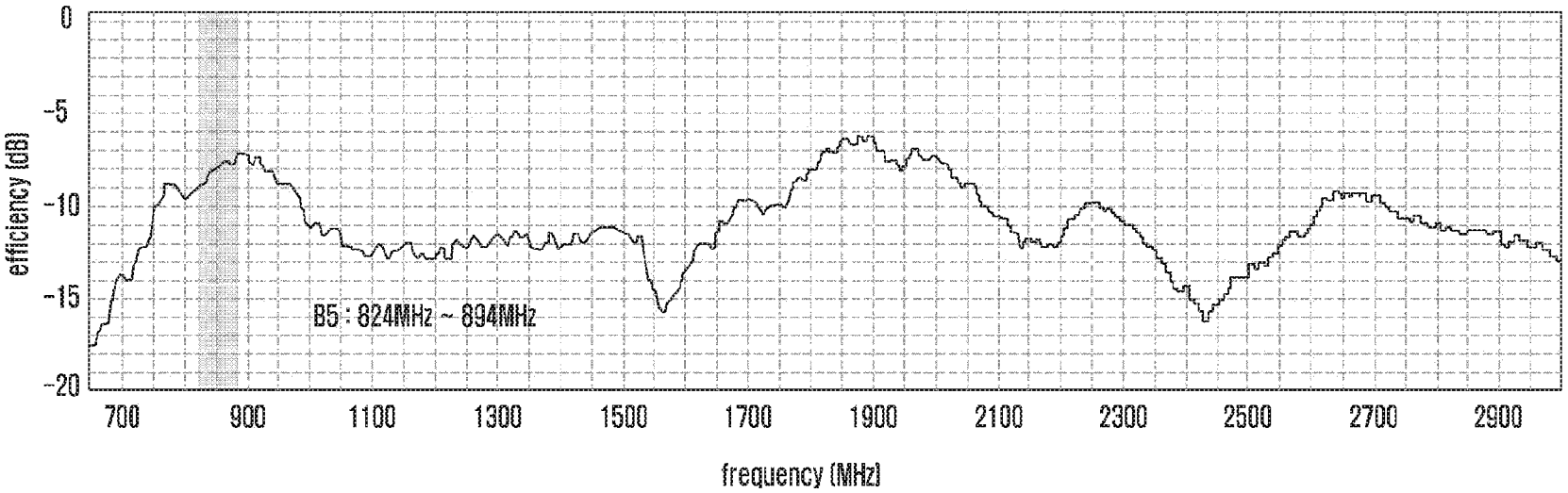
FIG. 7B is a graph illustrating a frequency characteristic that may be formed in the electronic device of FIG. 7A according to various embodiments of the present disclosure.

FIG. 7A is a block diagram illustrating a path of an electric signal of an electronic device according to various embodiments of the present disclosure, and FIG. 7B is a graph illustrating a frequency characteristic that may be formed in the electronic device of FIG. 7A.

Referring to FIG. 7A, an antenna device 700 may be an element of an electronic device (e.g., the electronic device 101), and a first radiating body 715*a*, a second radiating body 715*b* and/or a third radiating body 715*c* may be elements of the first metal portion 415*a* or 416*a*, the second metal portion 415*b* or 416*b*, and the third metal portion 415*c* or 416*c*, respectively. For example, a first separation portion 715*d* may be an element of the first nonmetallic portion 415*d* or 416*d*. For example, a second separation portion 715*e* may be an element of the second nonmetallic portion 415*e* or 416*e*.

The first radiating body 715*a* may be electrically connected to a first connection portion 721 and a second connection portion 722. Although not shown in the drawing, the first connection portion 721 and the second connection portion 722 may be mounted in a substrate, and when the substrate contacts the connection portions 721 and 722 of the first radiating body 715*a*, the first radiating body 715*a* may be electrically connected to the first connection portion 721 and/or the second connection portion 722.

Further, the antenna device 700 may include an RF switch 750 electrically connected to the second radiating body 715*b*. A circuit configuration of the second radiating body 715*b* may be changed according to a signal applied to the RF switch 750. A resonant path of a low band frequency, a mid-band frequency, and a high band frequency may be formed and emission efficiency can be enhanced through the changed circuit configuration.

According to various embodiments of the present disclosure, the first radiating body 715*a*, the first connection portion 721, and the second connection portion 722 may be connected. A circuit of a ground 730 may be formed between the first connection portion 721 and the second connection portion 722, between the first connection portion 721 and the second separation portion 715*e*, which is a resonant path, or between the second connection portion 722 and the first separation portion 715*d*, which is a resonant path.

A first RF signal of a first frequency band (e.g., 600 Mhz-1 GHz; a low band frequency) may be output to the first connection portion 721. A second RF signal of a second frequency band (e.g., 1.5 GHz-2.2 GHz, 2.5 GHz-2.7 GHz; mid and high band frequencies) may be output to the second connection portion 722.

According to various embodiments of the present disclosure, when a first RF signal is output from the first connection portion 721, a plurality of resonant paths may be formed in the electronic device. The plurality of resonant paths may be resonant paths from the first connection portion 721 to the ground 730 via the first radiating body 715*a*.

When a first RF signal is applied to the first radiating body 715*a*, an influence by the ground 730 is relatively large and thus the plurality of resonant paths may not be formed through the second radiating body 715*b*.

Referring to FIG. 7B, which is an experiment graph when the first RF signal is applied to the first radiating body 715*a* by the RF switch 750, in for example, approximately a band 824-894 MHz (Band 5) of a frequency of a first RF signal emitted from the electronic device by a plurality of resonant paths, high emission efficiency exceeding −6 dB may be obtained.

Figure 8A:
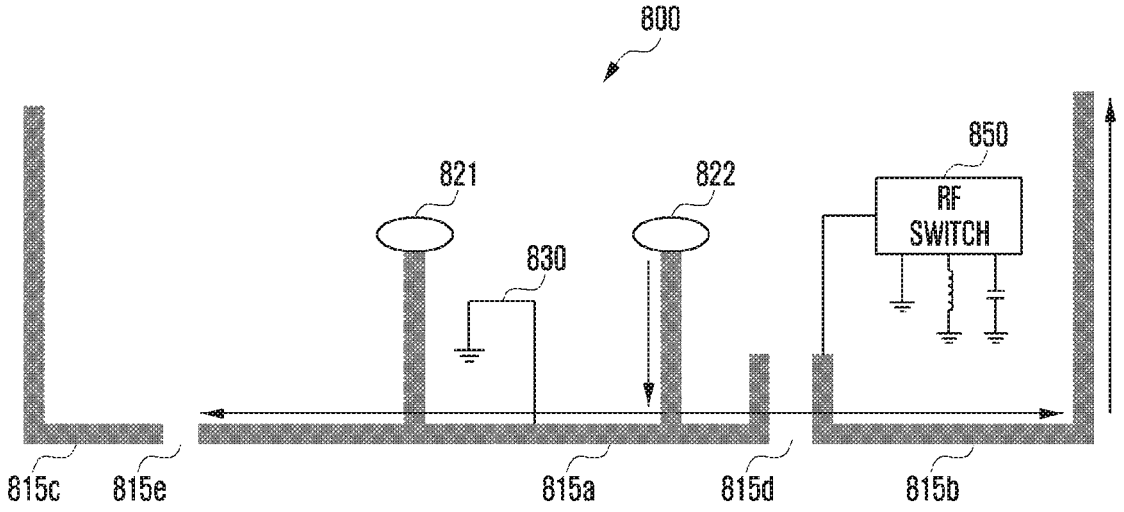
FIG. 8A is a block diagram illustrating a path of an electric signal of an electronic device according to various embodiments of the present disclosure.
Figure 8B:
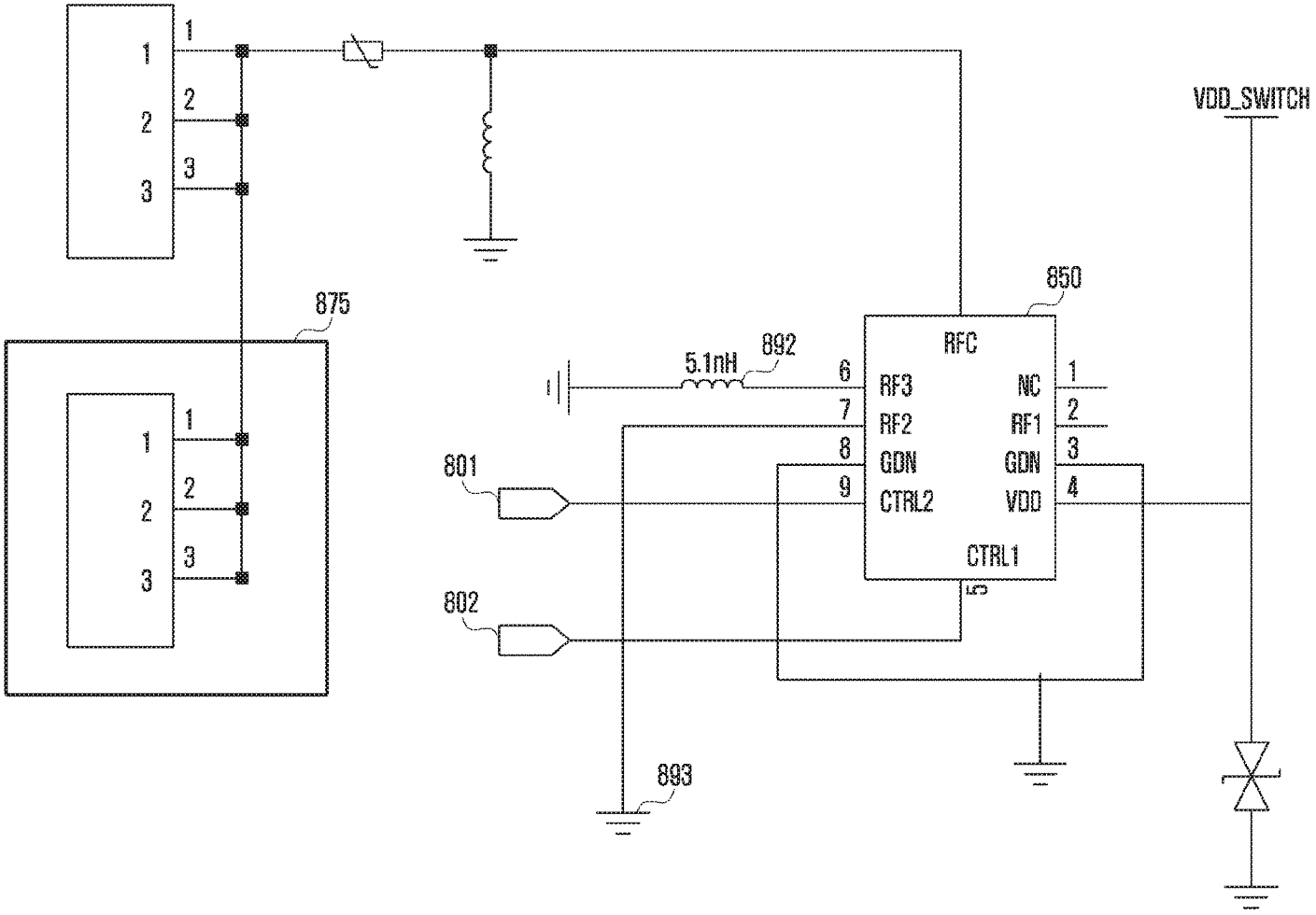
FIG. 8B is a circuit diagram illustrating a radio frequency (RF) switch mounted in the electronic device of FIG. 8A according to various embodiments of the present disclosure.
Figure 8C:
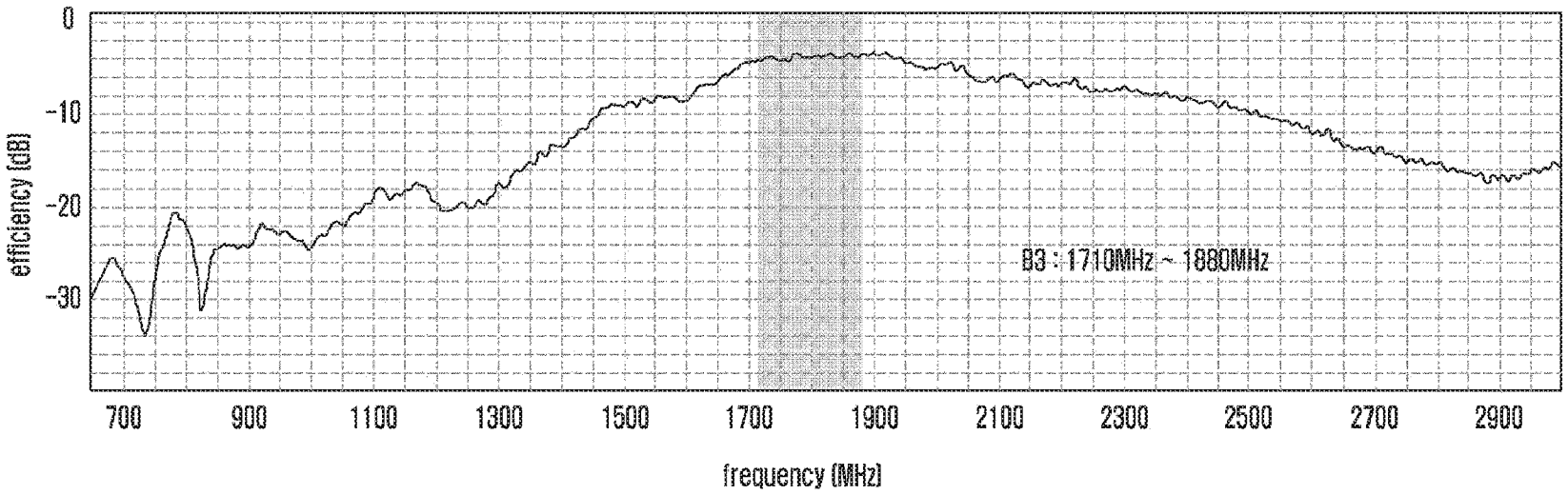
FIGS. 8C, 8D, and 8E are graphs illustrating a frequency characteristic that may be formed in the electronic device of FIG. 8A according to various embodiments of the present disclosure.
Figure 8D:
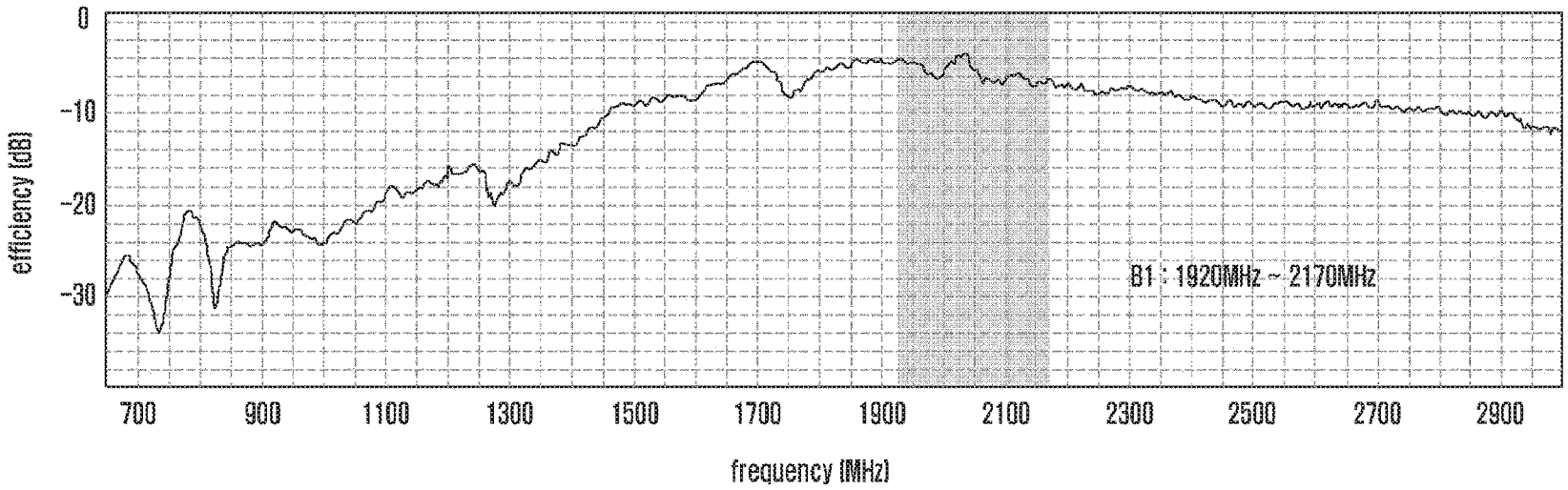
Figure 8E:
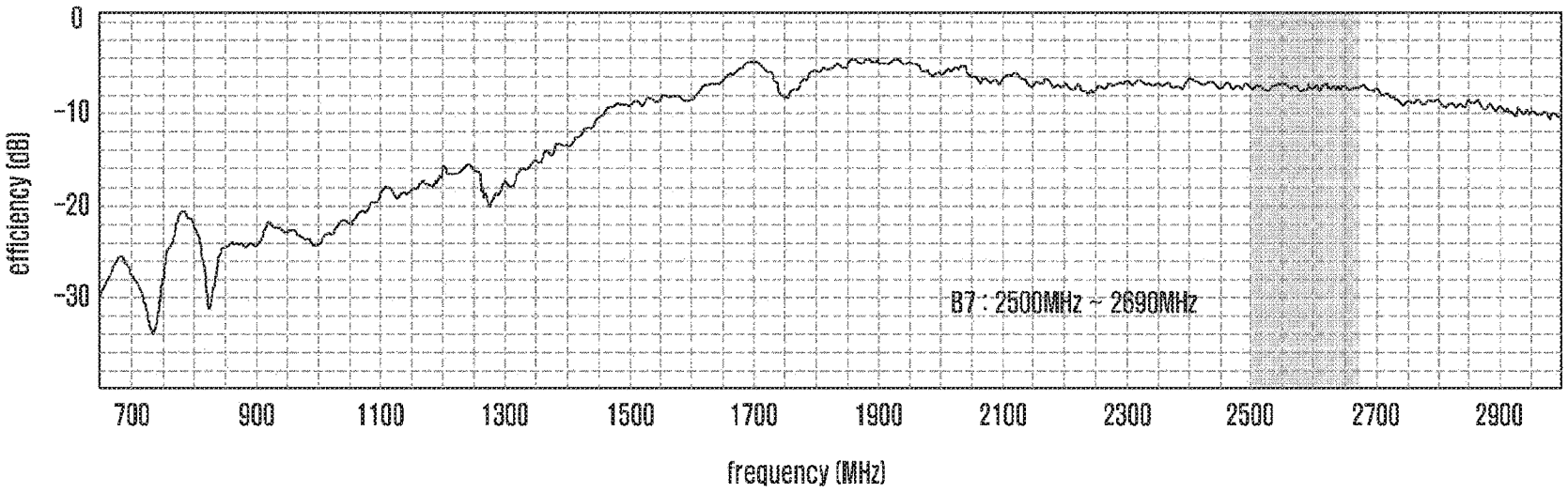

FIG. 8A is a block diagram illustrating a path of an electric signal of an electronic device according to various embodiments of the present disclosure, FIG. 8B is a circuit diagram illustrating an RF switch mounted in the electronic device of FIG. 8A according to various embodiments of the present disclosure, and FIGS. 8C, 8D and 8E are graphs illustrating a frequency characteristic that may be formed in the electronic device of FIG. 8A according to various embodiments of the present disclosure.

Referring to FIG. 8A, an antenna device 800 may be an element of the electronic device (e.g., the electronic device 101), and a first radiating body 815*a*, second radiating body 815*b* and/or third radiating body 815*c* may be an element of the first metal portion 415*a* or 416*a*, the second metal portion 415*b* or 416*b*, and the third metal portion 415*c* or 416*c*, respectively. For example, a first separation portion 815*d* may be an element of the first nonmetallic portion 415*d* or 416*d*. For example, a second separation portion 815*e* may be an element of the second nonmetallic portion 415*e* or 416*e*.

The first radiating body 815*a* may be electrically connected to a first connection portion 821 and a second connection portion 822. Although not shown in the drawing, the first connection portion 821 and the second connection portion 822 may be mounted in a substrate, and when the substrate contacts the connection portions 821 and 822 of the first radiating body 815*a*, the first radiating body 815*a* may be electrically connected to the first connection portion 821 and/or the second connection portion 822.

The first separation portion 815*d* is formed between the first radiating body 815*a* and the second radiating body 815*b*, and the first separation portion 815*d* may be represented with coupling capacitance.

Further, the antenna device 800 may include an RF switch 850 electrically connected to the second radiating body 815*b*. A circuit configuration of the second radiating body 815*b* may be changed according to a signal applied to the RF switch 850. A resonant path of a low band frequency, a mid-band frequency, and a high band frequency may be formed and emission efficiency can be enhanced through the changed circuit configuration.

According to various embodiments of the present disclosure, the first radiating body 815*a*, the first connection portion 821, and the second connection portion 822 may be connected. A circuit of a ground 830 may be formed between the first connection portion 821 and the second connection portion 822, between the first connection portion 821 and the second separation portion 815*e*, which is a resonant path, or between the second connection portion 822 and the first separation portion 815*d*, which is a resonant path.

A first RF signal of a first frequency band (e.g., 600 Mhz-1 GHz; low band frequency) may be output to the first connection portion 821. A second RF signal of a second frequency band (e.g., 1.5 GHz-2.2 GHz, 2.5 GHz-2.7 GHz; mid and high band frequencies) may be output to the second connection portion 822.

According to various embodiments of the present disclosure, when a second RF signal is output from the second connection portion 822, a plurality of resonant paths may be formed in the electronic device.

The plurality of resonant paths may be resonant paths from the second connection portion 822 to the ground 830 via at least one of the first radiating body 815*a* and the second radiating body 815*b*. In the resonant paths from the second connection portion 822 to the ground 830 via the first radiating body 815*a* and the second radiating body 815*b*, because the first separation portion 815*d* is represented with coupling capacitance, a resonant path passing through the first radiating body 815*a* and the second radiating body 815*b* may be formed.

According to various embodiments of the present disclosure, when connecting the RF switch 850 to an optimized passive element (e.g., an inductor L having a value of 5.1 nH) according to a signal applied to the RF switch 850, a resonant path of a mid-band frequency of a second frequency band may be formed and emission efficiency can be enhanced.

Further, by connecting the RF switch 850 to the ground according to a signal applied to the RF switch 850, a resonant path of a high band frequency of the second frequency band may be formed and emission efficiency can be enhanced.

Referring to FIG. 8B, which is a circuit diagram of the RF switch 850 for detailed description, the circuit diagram may be formed with the RF switch 850 and a second radiating body 875 electrically connected to the RF switch 850.

The RF switch 850 may be mounted in the second substrate 502, and the third connection portion 533 of the RF switch 550 mounted in the second substrate 502 contacts the sixth connection portion 536 of the second radiating body 515*b* to be electrically connected thereto.

According to various embodiments of the present disclosure, the RF switch 850 inputs a signal to a first signal input unit 801 and a second signal input unit 802 to control the first signal input unit 801 and the second signal input unit 802. The RF switch 850 may include an RF choke (RFC). The RFC is an RF switch and may prevent an RF AC signal from being applied.

In an embodiment, when the first signal input unit 801 receives an input of a 'high' signal, which is a signal corresponding to a first level and when the second signal input unit 802 receives an input of a 'low' signal, which is a signal corresponding to a second level, a circuit configuration of the second radiating body 815*b* may be changed.

For example, as described above, when a resonant path is formed from the first connection portion 721 to the ground 730 via the first radiating body 715*a*, if the signal is applied to the RF switch 750, a circuit configuration of the second radiating body 715*b* is changed and thus a resonant path to the second radiating body 715*b* may not be formed. In such a case, high emission efficiency of a low band frequency of an RF signal applied from the first connection portion 721 can be obtained.

In another embodiment, when the first signal input unit receives an input of a 'low' signal, which is a signal corresponding to a second level and when the second signal input unit receives an input of a 'low' signal, which is a signal corresponding to a second level, the RF switch 850 may be electrically connected to an optimized passive element 892 (e.g., an inductor L having a value of 5.1 nH).

For example, when the signal is applied to the RF switch 850, as described above, if a resonant path is formed from the second connection portion 822 to the ground 830 via at least one of the first radiating body 815*a* and the second radiating body 815*b*, high emission efficiency of a mid-band frequency of an RF signal applied from the second connection portion 822 can be obtained.

Referring to FIG. 8C, which is an experiment graph when the RF switch 850 is electrically connected to an optimized passive element, in for example, approximately a band (Band 3) 1710-1880 MHz of a frequency of a second RF signal emitted from the electronic device by a plurality of resonant paths, high emission efficiency exceeding −4 dB may be obtained.

Referring to FIG. 8D, which is an experiment graph when the RF switch 850 is electrically connected to an optimized passive element, in for example, approximately a band (Band 1) 1920-2170 MHz of a frequency of a second RF signal emitted from the electronic device by a plurality of resonant paths, high emission efficiency exceeding −4 dB may be obtained.

In another embodiment, when the first signal input unit receives an input of a 'low' signal, which is a signal corresponding to a second level and when the second signal input unit receives an input of a 'high' signal, which is a signal corresponding to a first level, the RF switch 850 may be connected to the ground 893.

For example, when the signal is applied to the RF switch 850, as described above, if a resonant path is formed from the second connection portion 822 to the ground 830 via at least one of the first radiating body 815*a* and the second radiating body 815*b*, high emission efficiency of a high band frequency of an RF signal applied from the second connection portion 822 can be obtained.

Referring to FIG. 8E, which is an experiment graph when the RF switch 850 is connected to the ground, in for example, approximately a band (Band 7) 2500-2690 MHz of a frequency of a second RF signal emitted from the electronic device by a plurality of resonant paths, high emission efficiency exceeding −4 dB may be obtained.

An electronic device according to the present disclosure can perform wireless communication in a broadband using a plurality of power supply units and a plurality of antennas.

While the present disclosure has been shown and described with reference to various embodiments thereof, it should be understood by those skilled in the art that various changes in form and details may be made therein without departing from the spirit and scope of the present disclosure as defined in the appended claims and their equivalents.

What is claimed is:

1. An electronic device comprising:

a housing;

a radio frequency (RF) circuit located within the housing and configured to output a first RF signal and a second RF signal;

at least one processor located within the housing and configured to electrically connect to the RF circuit;

a first radiating body electrically connected to the RF circuit;

a second radiating body electrically connected to the first radiating body; and an RF switch located within the housing and electrically connected to the at least one processor and the second radiating body, wherein the at least one processor is further configured to control the RF switch to emit at least one of the first RF signal and the second RF signal output from the RF circuit to at least one of the first radiating body and the second radiating body, wherein the first radiating body and the second radiating body are separated by a nonmetallic portion and connected by an inductive coupling method, wherein the at least one processor is further configured to control the RF switch and the RF circuit to output the first RF signal to the first radiating body, and wherein the at least one processor is further configured to control the RF switch and the RF circuit to output the second RF signal to the first radiating body and the second radiating body.

2. The electronic device of claim 1, wherein the RF switch changes a circuit configuration of the second radiating body according to the at least one processor.

3. The electronic device of claim 1, wherein the at least one processor is further configured to control the RF switch according to a frequency band change.

4. The electronic device of claim 1, wherein the RF switch is electrically connected to the ground or a passive element according to the at least one processor.

5. The electronic device of claim 1, wherein the first RF signal is a low frequency band signal, and wherein the second RF signal is at least one of a mid-frequency band signal and a high frequency band signal.

6. The electronic device of claim 1, wherein the first RF signal is output from a first connection portion of the RF circuit, and wherein the second RF signal is output from a second connection portion of the RF circuit.

7. The electronic device of claim 1, wherein the first radiating body is connected to the ground, and wherein the second radiating body is coupled to the first radiating body to be electrically connected thereto.

8. The electronic device of claim 1, further comprising:

a substrate located within the housing, wherein the substrate is formed in at least one of a printed circuit board (PCB) and a flexible circuit board (FPCB).

9. The electronic device of claim 1, wherein the housing comprises a side surface member, wherein the side surface member comprises a first conductive portion, second conductive portion, third conductive portion, first non-conductive portion, and second non-conductive portion, wherein the first non-conductive portion is inserted between the first conductive portion and the second conductive portion, and wherein the second non-conductive portion is inserted between the first conductive portion and the third conductive portion.

10. The electronic device of claim 9, wherein the first radiating body or the second radiating body is one of the first conductive portion, the second conductive portion, and the third conductive portion.

11. An electronic device comprising:

a housing;

a radio frequency (RF) circuit located within the housing and configured to output a first RF signal and a second RF signal;

at least one processor located within the housing and electrically connected to the RF circuit;

a first radiating body electrically connected to the RF circuit;

a second radiating body electrically connected to the first radiating body; and an RF switch located within the housing and electrically connected to the at least one processor and the second radiating body, wherein the RF switch is connected to at least a portion of the second radiating body adjacent to the first radiating body, wherein the first radiating body and the second radiating body are separated by a nonmetallic portion and connected by an inductive coupling method, wherein the at least one processor is further configured to control the RF switch and the RF circuit to output the first RF signal to the first radiating body, and wherein the at least one processor is further configured to control the RF switch and the RF circuit to output the second RF signal to the first radiating body and the second radiating body.

12. The electronic device of claim 11, wherein the RF switch changes a circuit configuration of the second radiating body according to the at least one processor.

13. The electronic device of claim 11, wherein the at least one processor is further configured to control the RF switch according to a frequency band change.

14. The electronic device of claim 11, wherein the RF switch is electrically connected to Eground or a passive element according the at least one processor.

15. The electronic device of claim 11, wherein the first RF signal is a low frequency band signal, and wherein the second RF signal is at least one of a mid-frequency band signal and a high frequency band signal.

16. The electronic device of claim 11, wherein the first RF signal is output from a first connection portion of the RF circuit, and wherein the second RF signal is output from a second connection portion of the RF circuit.

* * * * *